US009490550B2

(12) United States Patent
Otsuka et al.

(10) Patent No.: US 9,490,550 B2
(45) Date of Patent: Nov. 8, 2016

(54) ALUMINUM-BASED TERMINAL FITTING

(75) Inventors: Takuji Otsuka, Yokkaichi (JP); Hiroki Hirai, Yokkaichi (JP); Junichi Ono, Yokkaichi (JP); Kingo Furukawa, Yokkaichi (JP); Teruyoshi Munekata, Yokkaichi (JP); Hajime Ota, Osaka (JP); Yoshihiro Nakai, Osaka (JP); Taichiro Nishikawa, Osaka (JP); Tetsuya Kuwabara, Osaka (JP); Yoshiyuki Takaki, Osaka (JP); Hiroyuki Kobayashi, Osaka (JP)

(73) Assignees: AUTONETWORKS TECHNOLOGIES, LTD., Yokkaichi-shi, Mie (JP); SUMITOMO ELECTRIC INDUSTRIES, LTD., Osaka-shi, Osaka (JP); SUMITOMO WIRING SYSTEMS, LTD., Yokkaichi-shi, Mie (JP)

( * ) Notice: Subject to any disclaimer, the term of this patent is extended or adjusted under 35 U.S.C. 154(b) by 0 days.

(21) Appl. No.: 14/241,994

(22) PCT Filed: Aug. 22, 2012

(86) PCT No.: PCT/JP2012/071239
§ 371 (c)(1),
(2), (4) Date: Feb. 28, 2014

(87) PCT Pub. No.: WO2013/031611
PCT Pub. Date: Mar. 7, 2013

(65) Prior Publication Data

US 2014/0235116 A1 Aug. 21, 2014

(30) Foreign Application Priority Data

Aug. 31, 2011 (JP) ..... 2011-190135

(51) Int. Cl.
*H01R 4/10* (2006.01)
*H01R 4/18* (2006.01)
(Continued)

(52) U.S. Cl.
CPC ..... *H01R 4/185* (2013.01); *H01R 4/62* (2013.01); *H01R 13/03* (2013.01)

(58) Field of Classification Search
CPC ..... H01R 4/62; H01R 4/185; H01R 13/03; H01R 43/048
USPC ..... 439/877, 887, 886
See application file for complete search history.

(56) References Cited

U.S. PATENT DOCUMENTS 2,423,290 A * 7/1947 Bonwitt ..... H01R 4/62 106/272
3,108,006 A * 10/1963 Gore ..... C23C 18/31 106/1.25

(Continued)

FOREIGN PATENT DOCUMENTS

CN 1610993 4/2005
JP 10-302864 11/1998

(Continued)

OTHER PUBLICATIONS

International Search Report of Oct. 26, 2012.

(Continued)

*Primary Examiner* — Neil Abrams
*Assistant Examiner* — Travis Chambers
(74) *Attorney, Agent, or Firm* — Gerald E. Hespos; Michael J. Porco; Matthew T. Hespos

(57) ABSTRACT

Provided are an aluminum-based terminal fitting in which a Sn layer has high peel resistance, and a terminal connecting structure of an electric wire provided with the terminal fitting. The aluminum-based terminal fitting includes a wire barrel portion (110) for connection to a conductor (210) constituted by aluminum or an aluminum alloy and provided in an electric wire (200), and a fitting portion (female fitting portion (130) or male fitting portion (140)) provided to extend from the wire barrel portion (110) and electrically connected to a separate terminal fitting. A Sn layer formed directly on a base material constituting the terminal fitting is provided on the contact region in the fitting portion.

12 Claims, 7 Drawing Sheets

(51) Int. Cl.
*H01R 4/62* (2006.01)
*H01R 13/03* (2006.01)

(56) References Cited

U.S. PATENT DOCUMENTS

| | | | | |
|---|---|---|---|---|
| 4,039,244 | A * | 8/1977 | Leachy | 439/887 |
| 4,169,770 | A * | 10/1979 | Cooke | C25D 5/44 204/207 |
| 4,670,312 | A * | 6/1987 | Ehrsam | C25D 5/44 205/184 |
| 5,248,262 | A * | 9/1993 | Busacco et al. | 439/66 |
| 6,183,885 | B1 | 2/2001 | Nakamura et al. | |
| 8,496,504 | B2 * | 7/2013 | Ono | H01R 4/185 439/877 |
| 8,915,761 | B2 * | 12/2014 | Kakuta | H01R 13/03 428/647 |
| 2001/0024895 | A1 * | 9/2001 | Sakiyama | H01R 13/03 439/181 |
| 2001/0031565 | A1 * | 10/2001 | Sakiyama | H01T 1/06 439/38 |
| 2005/0124233 | A1 | 6/2005 | Hammam | |
| 2007/0257372 | A1 * | 11/2007 | Tada | C23C 16/0281 257/763 |
| 2007/0258173 | A1 * | 11/2007 | Chen | G11C 5/04 361/42 |
| 2007/0264873 | A1 * | 11/2007 | Kakuta | 439/585 |
| 2008/0080978 | A1 * | 4/2008 | Zimmerman | C25D 3/50 416/241 R |
| 2009/0074903 | A1 * | 3/2009 | Kotaka | B29C 45/2632 425/470 |
| 2010/0255735 | A1 * | 10/2010 | Moriuchi et al. | 439/886 |
| 2011/0042201 | A1 * | 2/2011 | Von Gutfeld | C25D 5/02 204/200 |
| 2012/0115375 | A1 | 5/2012 | Kakuta | |

FOREIGN PATENT DOCUMENTS

| | | | |
|---|---|---|---|
| JP | 11-121075 | 4/1999 | |
| JP | 2004-006070 | 1/2004 | |
| JP | 2007-113080 | 5/2007 | |
| JP | 2010-165529 | 7/2010 | |
| JP | 2010-267418 | 11/2010 | |
| JP | 2010-267419 | 11/2010 | |
| JP | 2010-272414 | 12/2010 | |
| WO | WO 2010001851 A1 * | 1/2010 | H04R 4/185 |

OTHER PUBLICATIONS

Japanese Patent Application No. 2011-190135—Office Action issued Nov. 18, 2014.

Chinese Patent Appl. No. 201280039084.9—Office Action issued Jun. 30, 2015.

* cited by examiner

FIG.3A(a)
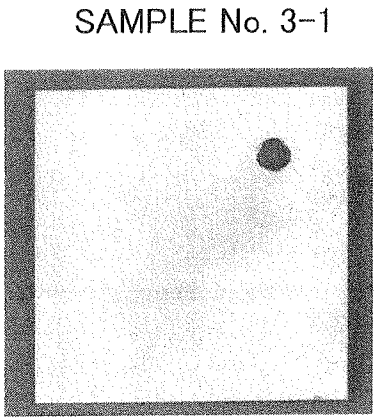
(b)
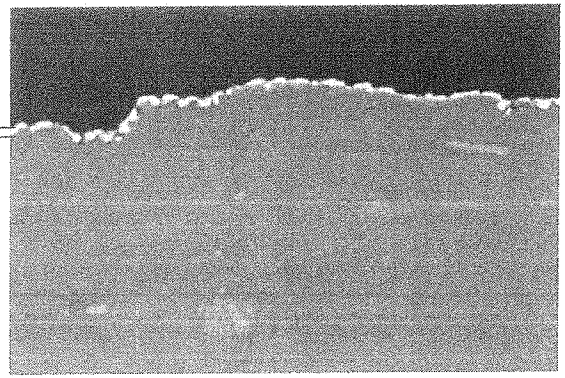
FIG.3A(b)
FIG.3B(a)
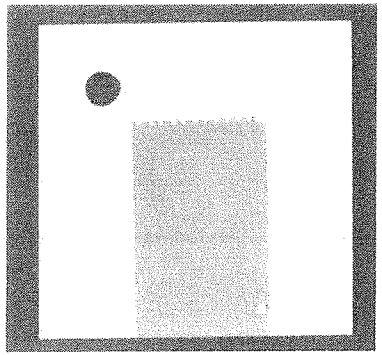
(b)
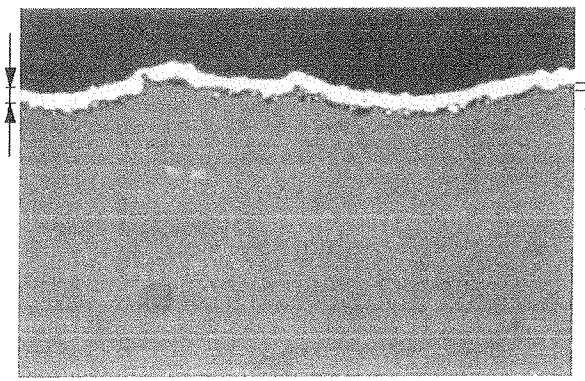
FIG.3B(b)

FIG.4A SAMPLE No. 3-2 (6061)
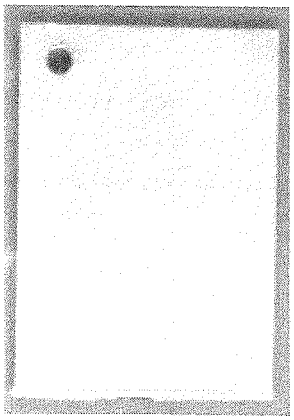
FIG.4B SAMPLE No. 3-3 (2219)
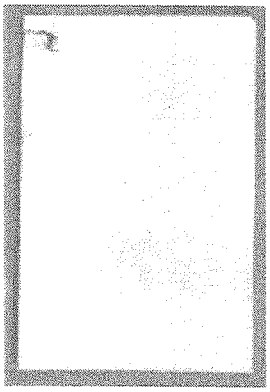
FIG.4C SAMPLE No. 3-4 (7075)
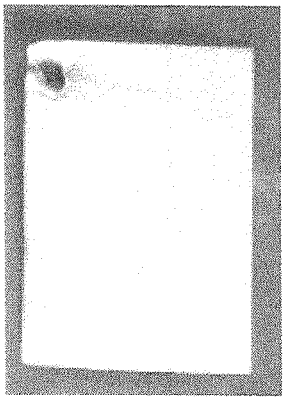

| SAMPLE No. | 4-1 | 4-2 | 4-3 | 4-4 |
|---|---|---|---|---|
| Sn LAYER DIAMETER (mm) THICKNESS (μm) | Φ 1.0mm 1.0μm | Φ 2.0mm 1.0μm | Φ 3.0mm 1.0μm | Φ 5.0mm 1.0μm |
| AFTER CORROSION TEST (EXTERNAL APPEARANCE) | 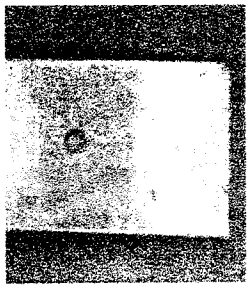 | 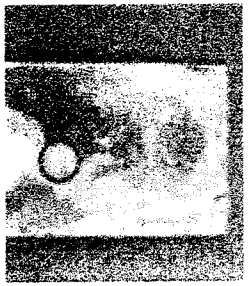 | 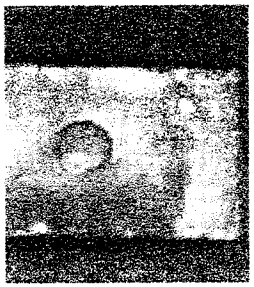 | 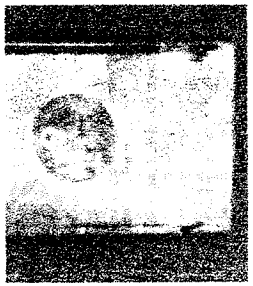 |
| PEELING OF Sn LAYER | NOT PRESENT | NOT PRESENT | PRESENT | PRESENT |
Fig 7

ALUMINUM-BASED TERMINAL FITTING

TECHNICAL FIELD

The present invention relates to an aluminum-based terminal fitting to be attached to a conductor constituted by aluminum or an aluminum alloy, and to a terminal connecting structure of an electric wire provided with such a terminal fitting. In particular, the present invention relates to an aluminum-based terminal fining in which a Sn layer provided on the surface has high peel resistance.

BACKGROUND ART

In electric wires used in movable equipment such as automobiles and airplanes and industrial equipment such as robots, an insulating layer is removed from an end portion to expose a conductor, and a terminal fitting is attached to the exposed portion. The terminal fitting may be of a variety of forms. For example, when the terminal fittings are connected to each other, a female terminal fitting 100F provided with a female fitting portion 130 or a male terminal fitting 100M provided with a male fitting portion 140, such as shown in FIG. 1, is used as an electric connecting portion that electrically connects the two terminal fittings.

The female terminal fitting 100F and the male terminal fitting 100M shown in FIG. 1 are both of a crimping type provided with a wire barrel portion 110, which has a pair of crimping pieces as main components, as a conductor connecting portion for connection to a conductor 210 provided at an electric wire 200. As shown in FIG. 1A, in the female terminal fitting 100F, a tubular female fitting portion 130 is provided to extend from one side of the wire barrel portion 110, and elastic pieces 131, 132 disposed opposite each other are provided inside the tubular body. In the male terminal fitting 100M, a rod-shaped male fitting portion 140 is provided to extend from one side of the wire barrel portion 110. Where the rod-shaped male fitting portion 140 is inserted into the tubular body of the female fitting portion 130 as shown in FIG. 1B, the male fitting portion 140 is strongly grasped by the biasing force of the elastic pieces 131, 132, and the two terminal fittings 100F, 100M are electrically connected to each other. In FIG. 1, only the female fitting portion 130 is shown by a sectional view to facilitate the understanding.

Copper materials such as copper or copper alloys, which excel in electric conductivity, are mainly used as constituent materials for conductive bodies or terminal fittings of electric wires. In recent years, the possibility of using, as constituent materials, aluminum or aluminum alloys (referred to hereinbelow as Al alloys), which have a specific gravity of about ⅓ that of Cu, in order to reduce the electric wires in weight has been studied (Japanese Patent Application Publication No. 2010-272414).

Japanese Patent Application Publication No. 2010-272414 suggests to provide a plated layer on the surface of the above-described fitting portion in order to reduce the electric connection resistance when the terminal fittings are connected to each other. The plated layer includes a Zn layer, a Cu layer, and a Sn layer, or a Zn layer, a Ni layer, a Cu layer, and a Sn layer, in the order of description from the base material. Since Sn (tin) is soft and easy to deform, sufficient conduction between the terminals fittings that are to be connected can be ensured by Sn deformation. In other words, by causing a Sn layer to function as a contact material, it is possible to reduce the connection resistance. Further, by covering the base material surface with such a plate layer, it is possible to prevent the oxidation of the Al alloy constituting the base material.

When a Sn layer is provided on the outer circumference of a terminal fitting constituted by an aluminum alloy, it is desirable that the Sn layer be closely attached to the terminal fitting over a long period of time. In particular, when the Sn layer is used as a contact material, it is desirable that the Sn layer have high peel resistance, since the peeling of the Sn layer increases the connection resistance.

The results of the investigation conducted by the inventors demonstrate that where a Zn layer is provided as an underlayer, as described in Patent Document 1, the Zn layer is eluted with time because of contact corrosion of dissimilar metals and, therefore, the Sn layer provided on the outer circumference of the Zn layer can peel off. For this reason, it is desirable to develop an aluminum-based terminal fitting in which a Sn layer can be sufficiently present, without falling off, over a long period of time.

SUMMARY OF THE INVENTION

Accordingly, it is an object of the present invention to provide an aluminum-based terminal fitting in which a Sn layer has high peel resistance. Another object of the present invention is to provide an aluminum-based terminal fitting such that connection resistance can be reduced when the terminal fittings are connected together. Yet another object of the present invention is to provide a terminal connecting structure of an electric wire provided with the aluminum-based terminal fitting.

The present invention attains the object by forming a Sn layer directly on the base material constituted by an aluminum alloy. The terminal fitting in accordance with the present invention is an aluminum-based terminal fitting including a conductor connecting portion for connection to a conductor of an electric wire, and an electric connecting portion that is provided to extend from the conductor connecting portion and is electrically connected to a separate connection object. The terminal fitting is to be attached to the conductor constituted by aluminum or an aluminum alloy. Further, a Sn layer directly formed on a base material constituting the terminal fitting is provided on at least a contact region in the electric connecting portion on the surface of the terminal fitting.

The terminal connecting structure of an electric wire in accordance with the present invention includes an electric wire provided with a conductor, and a terminal fitting attached to the end portion of the conductor, and the conductor is constituted by aluminum or an aluminum alloy. The terminal fitting is the aluminum-based terminal fitting in accordance with the present invention which is provided with the Sn layer.

In the aluminum-based terminal fitting in accordance with the present invention, the Sn layer is directly formed on the surface of the base material constituted by an aluminum alloy, no Zn layer is provided between the base material and the Sn layer. For this reason, in the terminal fitting in accordance with the present invention, the Sn layer is not lost or peeled off following the elution of Zn layer caused by contact corrosion of dissimilar metals, and the Sn layer can be sufficiently maintained over a long period of time. Since the Sn layer is provided in the contact region and used as a contact material, in the terminal fitting in accordance with the present invention, contact resistance with a separate connection object can be reduced and a state with a low connection resistance can be maintained over a long period of time. Further, the region covered by the Sn layer outside the contact region can be prevented from corrosion.

Since the terminal contact structure of an electric wire in accordance with the present invention is provided with the terminal fitting in accordance with the present invention, a connecting structure demonstrating a low connection resistance or a high oxidation prevention effect for a long period of time can be constructed and loss caused by the increase in connection resistance can be inhibited.

In an embodiment of the terminal fitting in accordance with the present invention, the electric connecting portion is a fitting portion that is fitted into and electrically connected to a separate terminal fitting, and the Sn layer is provided on a contact region in the fitting portion.

In this embodiment, the terminal fittings are connected to each other, and by providing the Sn layer at least on the contact region, it is possible to cause the Sn layer to function as a contact material and to reduce the connection resistance. Further, in this embodiment, the state with a low connection resistance can be maintained over a long period of time.

In an embodiment of the terminal fitting in accordance with the present invention, the Sn layer includes an immersion-plated layer and an electroplated layer in the order of description from the base material constituting the terminal fitting, and the thickness of the immersion-plated layer is 0.05 μm (inclusive) to 0.3 μm (inclusive), the thickness of the electroplated layer is 0.25 μm (inclusive) to 1.7 μm (inclusive), and the total thickness of the two plated layers is 0.3 μm (inclusive) to 2 μm (inclusive).

Since aluminum alloys are active metals, where they are exposed to oxygen-containing atmosphere such as air, a self-oxidation film is formed. Where the self-oxidation film is present, the plated metal is unlikely to bond sufficiently to the base material. Since the self-oxidation film is an electric insulator, the plated layer is difficult to form by using an electroplating method for which conduction is necessary. For those reasons, the Zn layer is formed by performing zincate treatment in Patent Document 1, but where the Zn layer is formed, the Sn layer can fall off with the passage of time as mentioned hereinabove. Accordingly, the inventors formed a Sn layer by immersion plating or vacuum plating, e.g. plasma sputtering, the Sn layer, instead of performing the zincate treatment. As a result, when a thick Sn layer was formed, where the Sn layer was formed by using a single technique such as immersion plating, it was found that the Sn layer could peel off. The additional research demonstrated that where a thin layer is formed by immersion plating or sputtering and then a Sn layer of the desired thickness is formed by electroplating by using the thin layer as an underlayer, a Sn layer is obtained that has excellent adhesion to the base material constituted by an aluminum alloy. In particular, the immersion plating method makes it possible to form the plated layer faster than the vacuum plating method, and the productivity can be increased.

In this embodiment, where a composite layer is formed that includes a comparatively thin immersion-plated layer and a comparatively thick electroplated layer, the Sn layer is less likely to peel off and has better adhesion than the Sn layer formed by immersion plating to the same thickness as the composite layer. Furthermore, the presence of the Sn layer can be ensured over a long period of time. Further, in this embodiment, by providing a Sn layer of a specific thickness, it is possible to cause the Sn layer to function efficiently as a contact material or an oxidation preventing layer. In addition, in this embodiment, when the Sn layer is formed to a specific thickness, a thick film is obtained by the electroplating method that is comparatively easy to implement and the productivity is, therefore, high.

In an embodiment of the terminal fitting in accordance with the present invention, the Sn layer can be formed over the entire surface thereof. In this embodiment, since the entire aluminum alloy constituting the terminal fitting is covered with the Sn layer, the oxidation of the base material constituted by the aluminum alloy can be prevented and resistance to corrosion induced by external environment can be improved. Meanwhile, when the Sn layer is used as a contact material, the Sn layer can be provided only on part of the surface of the terminal fitting, more specifically, on the contact region in the electric connecting portion. In this case, in an embodiment of the terminal fitting in accordance with the present invention, the ratio of the surface area of the Sn layer to the exposed surface area of the base material is 0.02% (inclusive) to 0.6% (inclusive).

The research results obtained by inventors demonstrate that where the Sn layer is made relatively small as compared with the exposed surface area of the base material constituted by the aluminum alloy, more specifically, where the aforementioned surface area ratio is within the specific range, the elution of the base material caused by contact corrosion of dissimilar metals can be effectively reduced. Therefore, in this embodiment, by reducing the contact corrosion of dissimilar metals and ensuring the sufficient presence of the base material, it is possible to use effectively the Sn layer provided at least on the contact region as a contact material and a state with a low connection resistance can be maintained over a long period of time. The case in which the surface area ratio is within a predetermined range, for example, where the base material is assumed to be a 20 mm×20 mm aluminum alloy plate, is the case in which the Sn layer has a round region with a diameter ϕ of 0.5 mm (inclusive) to 2.5 mm (inclusive).

In an embodiment of the fitting terminal in accordance with the present invention, the base material constituting the terminal fitting is constituted by an aluminum alloy of at least one type selected from 2000 series alloys, 6000 series alloys, and 7000 series alloys.

Since the aforementioned aluminum alloys excel in mechanical properties such as bending ability, and heat resistance, pressing can be easily performed and excellent production ability can be attained in the embodiment, and the terminal fitting can be used in high-temperature environment (for example, at a temperature about 120° C. to 150° C. in automotive applications).

In the aluminum-based terminal fitting in accordance with the present invention and the terminal connecting structure of an electric wire in accordance with the present invention, the Sn layer has high peel resistance.

BRIEF DESCRIPTION OF THE DRAWINGS

FIG. 1 is a schematic configuration diagram of a female terminal fitting and a male terminal fitting, in which

In FIG. 3A(a) is a photo showing the surface state of sample No. 3-1 after the adhesion test, and FIG. 3A(b) is a scanning electron micrograph (SEM photo) of a cross section of sample No. 3-1.

In FIG. 3B(a) is a photo showing the surface state of sample No. 3-100 after the adhesion test, and FIG. 3B(b) is a SEM photo of a cross section of sample No. 3-100.

FIG. 4 is a photo showing the surface state after the adhesion test, in which FIG. 4A shows sample No. 3-2, FIG. 4B shows sample No. 3-3, and FIG. 4C shows sample No. 3-4.

FIG. 7 is a microscopic image and element mapping of samples No. 4-1 to 4-4 that were subjected to a corrosion test under the same conditions as in Test Example 1.

BEST MODE FOR CARRYING OUT THE INVENTION

The present invention is described below in greater detail.

[Terminal Fitting]

[Composition]

The aluminum-based terminal fitting in accordance with the present invention is constituted by an aluminum alloy. Aluminum alloys of various compositions are available. In particular, there are compositions that excel in mechanical properties such as bending ability, and heat resistance, specific examples thereof including 2000 series alloys, 6000 series alloys, and 7000 series alloys conforming to JIS. The 2000 series alloys are Al—Cu alloys that are called duralumin and super duralumin and excel in strength. Examples of specific alloy numbers include 2024 and 2219. The 6000 series alloys are Al—Mg—Si alloys that excel in strength, corrosion resistance, and anodization ability. A specific alloy number is, for example, 6061. The 7000 series alloys are Al—Zn—Mg alloys called extra super duralumin and have a very high strength. A specific alloy number is, for example, 7075.

[Configuration]

The terminal fitting in accordance with the present invention is provided with a conductor connecting portion for connection to a conductor provided at an electric wire, and an electric connecting portion to be electrically connected to a separate connection object. The conductor connecting portion can be of a crimping type that crimps the conductor and of a melting type for connection to a molten conductor. In the crimping-type configuration, a wire battery portion based on a pair of crimping pieces or a single crimping tube is used as the conductor connecting portion. More specifically, a wire barrel portion can be considered that has a U-shaped cross portion and is constituted by a bottom portion where the conductor of the electric wire is disposed and a pair of crimping pieces that are provided vertically at the bottom portion and sandwich the conductor. The wire barrel portion is connected to the conductor when the crimping pieces are compressed to be bent. The crimping tube has a hole for inserting the conductor, and the wire barrel portion is connected to the conductor by inserting the conductor into the hole and compressing in this state.

Figure 1A:
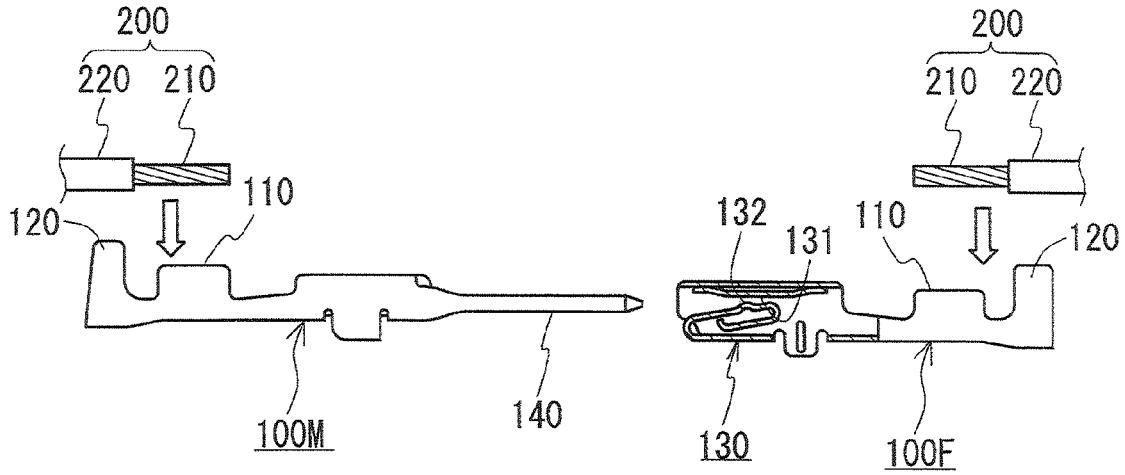
FIG. 1A shows a state before the two terminal fittings are fitted.
Figure 1B:
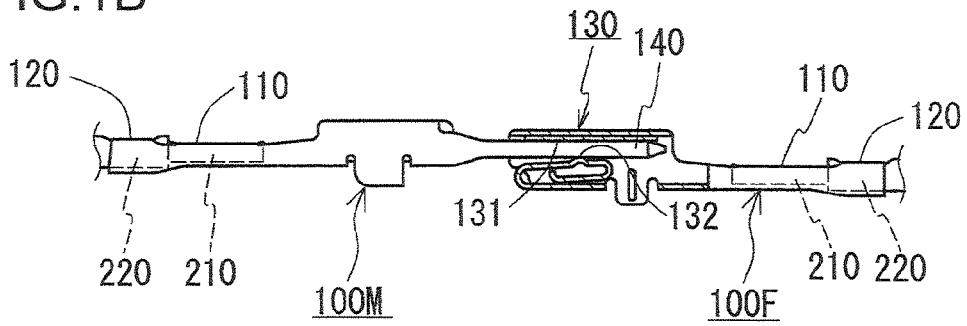
FIG. 1B shows a state in which the fitting portions of the two terminal fittings are fitted.

The electric connecting portion is provided to extend from one side of the conductor connecting portion and connected to an electronic device or a separate terminal fitting which is the connection object. Where the terminal fittings are connected to each other, the electric connecting portions can be in the form of the rod-shaped male fitting portion 140 and the female fitting portion 130 having elastic pieces 131, 132 disposed opposite each other, such as shown in FIG. 1 described hereinabove. Where the connection to a separate terminal fitting or electronic device is performed by using a fastening member such as a bolt, the electric connecting portion can be a fastening portion provided with a through hole or a U-shaped piece for inserting the fastening member thereinto. Alternatively, the electric connecting portion can be a flat-plate member to be inserted into a fitting hole provided in the connection object.

Further, the terminal fitting in accordance with the present invention can be provided with the insulation barrel portion 120 for crimping the insulating layer 220 of the electric wire 200 on the other side of the conductor connecting portion, as shown in FIG. 1. The terminal fitting in accordance with the present invention can use, as appropriate, the shape of a well-known terminal fitting having a conductor connecting portion and an electric connecting portion.

[Sn Layer]

The main feature of the terminal fitting in accordance with the present invention is that a Sn layer directly formed on a base material constituted by an aluminum alloy is provided on at least part of the surface of the terminal fitting. Since the Sn layer can be advantageously used as a contact material, in the terminal fitting in accordance with the present invention, the Sn layer is provided on the contact region in at least the above-described electric connecting portion. Further, since the Sn layer can function as an oxidation-preventing layer, the Sn layer can be also provided at a location where it is desirable to prevent oxidation corrosion, as an embodiment of the terminal fitting in accordance with the present invention.

The contact region is taken as a region of the electric connecting portion that is in direct contact with a separate connection object. In the configuration provided with the above-described fitting portions, in the case of the male terminal fitting, the contact region is at least part of two opposing surfaces of the rod-shaped male fitting portion that are in contact with the elastic pieces 131, 132 (FIG. 1) of the female fitting portion. In the case of the female terminal fitting, the contact region is at least part of the surfaces of the elastic pieces 131, 132 of the female fitting portion that are disposed opposite each other. In particular, where the Sn layer is provided such that the ratio of the surface area of the Sn layer to the exposed surface area of the base material (referred to hereinbelow as "surface area ratio") is 0.02% (inclusive) to 0.6% (inclusive), the elution of the base material (aluminum alloy) caused by contact corrosion of dissimilar metals can be effectively reduced and the Sn layer can be prevented from loss and peeling caused by elution of the base material. Therefore, when the Sn layer is provided on the contact region in the fitting portion and the Sn layer is used as the contact material, it is preferred that the surface area ratio be fulfilled. The smaller surface area ratio within the range facilitates the reduction of contact corrosion of dissimilar metals and the larger surface area ratio within the range ensures sufficient amount of contact material. A range of 0.1% (inclusive) to 0.4% (inclusive) is more preferred.

Where the thickness (total thickness) of the Sn layer is too large, deformation and friction become significant when the terminal fittings are connected to each other, and connection operability is degraded. Where the thickness is too small, wear occurs when the terminal fittings are connected to each other, the base material is exposed, and the desired functions cannot be sufficiently demonstrated. Therefore, the thickness of the Sn layer is preferably 0.3 μm (inclusive) to 2 μm (inclusive), more preferably 0.7 μm (inclusive) to 1.2 μm (inclusive). Where the thickness of the Sn layer is within the above-mentioned ranges, the Sn layer can be advantageously used as a contact material or oxidation preventing layer.

In the Sn layer, at least the region that is in contact with the base material is preferably formed by an immersion plating method which is a wet plating method, or a vacuum plating method (PVD method) which is a dry plating method. With the immersion plating method, a Sn layer can be formed while removing the natural oxidation film formed on the surface of the base material constituted by an aluminum alloy. Therefore, a Sn layer that excels in adhesion to the base material can be formed. Further, the immersion plating method makes it possible to form a Sn layer over a comparatively short period of time and excels in productivity. Examples of the vacuum plating method include a vacuum vapor deposition method, a sputtering method (for example, a plasma sputtering method), and an ion plating method. A natural oxidation film can be removed by vacuum plasma processing as pretreatment.

When the immersion plating method is used, the thickness of the immersion-plated layer is made equal to or less than 0.3 μm. Where the total thickness of the Sn layer is greater than 0.3 μm, it is preferred that a layer produced by a different technique be formed on the immersion-plated layer by using another technique such as an electroplating method so as to obtain the Sn layer of the desired thickness. As a result of producing a composite configuration by forming a thin immersion-plated layer, such as described hereinabove, and then forming a layer by a different technique, the Sn layer can be effectively prevented from peeling and the Sn layer of excellent adhesion can be obtained, by contrast with the case in which a thick immersion-plated layer is provided as a single layer. Where the thickness of the immersion-plated layer is equal to or greater than 0.05 μm, this layer can be sufficiently used as an underlayer for an electroplated layer, and a configuration in which an electroplated layer is provided thereupon can be easily formed. Where the layer provided on the immersion-plated layer is an electroplated layer, such a layer can be formed comparatively easily with excellent productivity. The thickness of the electroplated layer is preferably 0.25 μm (inclusive) to 1.7 μm (inclusive), more preferably 0.4 μm (inclusive) to 1.15 μm (inclusive). The thickness of the immersion-plated layer and the electroplated layer is selected such that the total thickness of the two layers is within the above-mentioned range (0.3 μm to 2 μm). The thickness of the Sn layer formed on the surface of the base material constituted by an aluminum alloy is an average value obtained by observing the cross section of the base material under a microscope and determining the average value of thickness in a measurement region (for example, when the Sn layer is formed in a round shape, a region with a thickness equal to or greater than 20% of the diameter thereof) selected from the observed image.

The Sn layer provided on the terminal fitting in accordance with the present invention excels in adhesion to the base material constituted by an aluminum alloy. More specifically, substantially no peeling occurs when the below-described adhesion test is performed. Further, where a cross section is obtained, the cross section is observed under a scanning electron microscope (SEM, magnification: ×1,000 to about ×10,000), and a random measurement length (for example, when the Sn layer is formed in a round shape, the length equal to or greater than 20% of the diameter thereof) is selected from the observed image, substantially no voids are present at the boundary of the base material and the Sn layer in the region taking 95% or more of the measurement length.

[Manufacturing Method]

Any of the terminal fittings of the above-described configuration typically can be manufactured by plastic processing including punching a sheet blank into a predetermined shape and pressing into a predetermined shape. The sheet blank can be manufactured by a process of casting→hot rolling→cold rolling→heat treatment of various types (for example, T6 treatment or T9 treatment).

The terminal fitting in accordance with the present invention basically can be manufactured by the following procedure: production of the above-described sheet blank ⇒ punching ⇒ pressing. The Sn layer is formed in the desired region over a random period of time of the manufacturing process, more specifically at a sheet blank stage, a stage of a blank piece punched into the predetermined shape, and a stage of the shaped body obtained by pressing. At the sheet blank and blank piece stage, the object for forming the Sn layer has a flat shape. Therefore, the Sn layer can be formed easily and with excellent productivity. At the shaped body stage, the Sn layer can be formed with high accuracy in the desirable region. The locations where the Sn layer is not to be formed, are masked in advance. The immersion plating method, vacuum plating method, or electroplating method can be used, as described hereinabove, to form the Sn layer. The conditions (in the case of the immersion plating layer or electroplating layer, the material of the washing liquid used in a washing step prior to plating, the material of the plating solution, temperature, time, and current density; in the case of a vacuum plating method, the degree of vacuum and the target temperature) are adjusted to obtain the desired thickness of the Sn layer. In the above-mentioned methods, the Sn layer is easily decreased in thickness by reducing the immersion time in the plating solution, excitation tine, or vapor deposition time.

[Terminal Connecting Structure of Electric Wire]

[Electric Wire]

The electric wire for attaching the terminal fitting in accordance with the present invention includes a conductor and an insulating layer provided on the outer circumference of the conductor. The conductor is constituted by aluminum or an aluminum alloy (Al alloy and the like). In other words, the terminal connecting structure of the electric wire in accordance with the present invention is the connecting structure of a terminal fitting constituted by an aluminum alloy and a conductor constituted by an Al alloy or the like, that is, a connecting structure in which the main components are metals of the same kind, and substantially no cell corrosion occurs between the conductor and the terminal fitting.

The aluminum alloy constituting the conductor, for example, includes a total of 0.005% by mass (inclusive) to 5.0% by mass (inclusive) of at least one element selected from Fe, Mg, Si, Cu, Zn, Ni, Mn, Ag, Cr, and Zr, with the balance being Al and impurities. The following content ratios of the elements are preferred (percent by mass): Fe 0.005% (inclusive) to 2.2% (inclusive), Mg 0.05% (inclusive) to 1.0% (inclusive), Mn, Ni, Zr, Zn, Cr, and Ag a total of 0.005% (inclusive) to 0.2% (inclusive), Cu 0.05% (inclusive) to 0.5% (inclusive), and Si 0.04% (inclusive) to 1.0% (inclusive). Only one of those additional elements or a combination of two or more thereof can be included. In addition to the abovementioned additional elements, Ti and B can be contained within a range below 500 ppm (inclusive) (mass ratio). Examples of alloys comprising the additional elements include Al—Fe alloys, Al—Fe—Mg alloys, Al—Fe—Mg—Si alloys, Al—Fe—Si alloys, Al—Fe—Mg-(at least one of Mn, Ni, Zr, and Ag), Al—Fe—Cu alloys, Al—Fe—Cu-(at least one of Mg and Si) alloys, and Al—Mg—Si—Cu alloys. A well-known aluminum alloy wire can be used as the wire constituting the conductor.

The wire constituting the conductor may be a single wire, a twisted wire obtained by twisting together a plurality of wires, or a compressed wire obtained by compressing a twisted wire. The diameter of the wire constituting the conductor (in the case of a twisted wire, the diameter of a single wire prior to twisting) can be selected, as appropriate, according to the application. For example, a wire with a diameter from 0.2 mm (inclusive) to 1.5 mm (inclusive) can be used.

The wire constituting the conductor (in the case of a twisted wire, the diameter of a single wire) has at least one of the following properties: tensile strength 110 MPa (inclusive) to 200 MPa (inclusive), 0.2% proof strength equal to or greater than 40 MPa, elongation equal to or greater than 10%, and electric conductivity equal to or greater than 58% IACS. In particular, the wire with an elongation equal to or greater than 10% excels in impact resistance and break resistance when the terminal fitting is attached to another terminal fitting, connector, or electronic device.

The insulating layer can be constituted of a variety of insulating materials, for example, poly(vinyl chloride) (PVC), a halogen-free resin composition based on polyolefin resins, and flame retardant compositions. The thickness of the insulating layer can be selected, as appropriate, with consideration for the desired insulation strength.

The conductor can be manufactured, for example, by a process including the steps of casting→hot rolling (→in the case of a cast billet: homogenizing treatment)→cold drawing (→softening treatment, twisting, and compression, as appropriate). The electric wire can be manufactured by forming the insulating layer on the conductor.

The conductor is exposed by stripping the insulating layer at the end portion of the electric wire, and the exposed portion is disposed at and connected to the conductor connecting portion of the terminal fitting in accordance with the present invention. For example, in the embodiment using a crimping piece, the conductor is disposed at the bottom portion of the conductor connecting portion, and the crimping piece is bent to enclose the conductor and then compressed. In this case, the compression state is adjusted such that the crimp height (C/H) has a predetermined value. With the above-described process, it is possible to manufacture the terminal connecting structure of the electric wire in accordance with the present invention, or a terminal-equipped electric wire in which the terminal fitting in accordance with the present invention is attached to the end of the electric wire.

Test Example 1

A metal plated layer including a Zn layer was formed on an aluminum alloy sheet, a corrosion test was conducted, and the state of contact corrosion of dissimilar metals was examined.

In the test, a 6000 series alloy (corresponds to the 6061 alloy) conforming to JIS was prepared and subjected to the T6 treatment (in this case, 550° C.×3 h→cooling with water→175° C.×16 h). The prepared aluminum alloy sheet was cut to the appropriate sizes to prepare test plates of various sizes. The test plates were subjected to zincate treatment under well-known conditions, and then an appropriate Ni layer was formed by electroplating under well-known conductions, a Sn layer was formed on the uppermost surface, and a sample including the Zn layer, Ni layer, and Sn layer, or the sample including the Zn layer and the Sn layer, in the order of description from the base material constituted by the aluminum alloy, was produced.

Figure 2A:
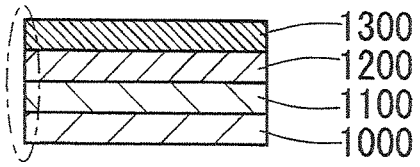
FIGS. 2A through 2E are schematic explanatory drawings illustrating the state of samples provided with a Zn layer produced in Test Example 1.
Figure 2B:
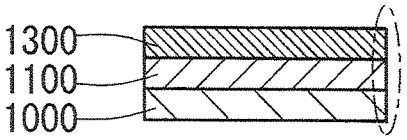

More specifically, sample No. A included a test plate 1000 constituted by the aluminum alloy, a Zn layer 1100, a Ni layer 1200, and a Zn layer 1300 in the order of description from the base material, as shown in FIG. 2A, and sample No. B included the test plate 1000 constituted by the aluminum alloy, the Zn layer 1100, and the Zn layer 1300 in the order of description form the base material, as shown in FIG. 2B. In samples No. A and B, the surface area SAl of one surface where the metal plated layer was provided in the test plate 1000 was made equal to the formation surface area of the layers 1100, 1200, and 1300.

Figure 2C:
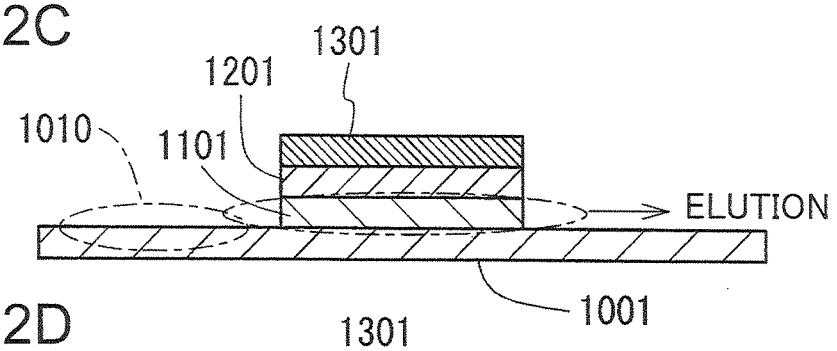
Figure 2D:
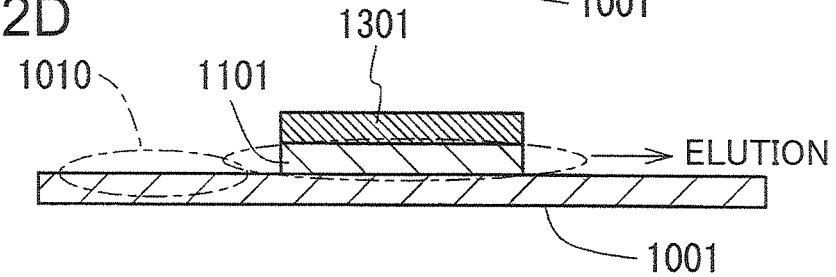
Figure 2E:
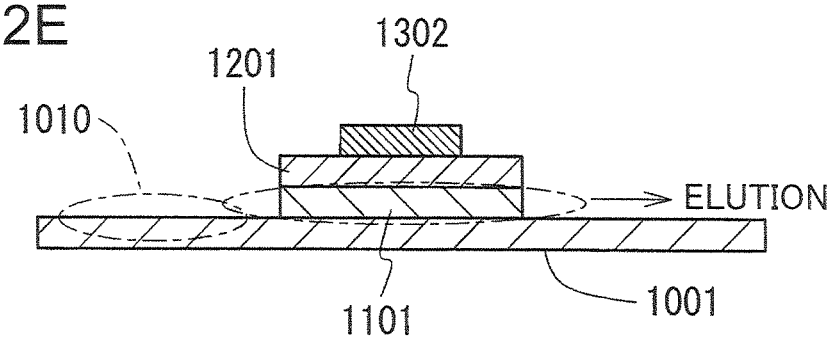

Sample No. C was provided with a test plate 1001 constituted by the aluminum alloy, a Zn layer 1101, a Ni layer 1201, and a Sn layer 1301, as shown in FIG. 2C. The formation surface areas of the layers 1101, 1201, and 1301 were equal to each other, and the formation surface areas of the layers 1101, 1201, and 1301 were less than the surface area SAl of the test plate 1001. Sample No. D had the configuration of sample No. C, except that no Ni layer was formed. As shown in FIG. 2D, the formation surface areas of the Zn layer 1101 and the Sn layer 1301 were equal to each other, and the formation surface areas of layers 1101 and 1301 were less than the surface area SAl of the test plate 1001. Sample No. E had the configuration of sample No. C in which the formation surface area of the Sn layer was changed. As shown in FIG. 2E, the formation surface areas of the Zn layer 1101 and the Ni layer 1201 were less than the surface area SAl of the test plate 1001, and the formation surface area of the Sn layer 1302 was even less. In FIG. 2, each metal plated layer is shown to have the same thickness as the test plate to facilitate the understanding, but the layers actually have different thicknesses. In the metal plated layers of samples No. A to E, the layers of the same material have the same thickness.

Samples No. A to E were subjected to a corrosion test and the corrosion state thereof was then checked. The corrosion test was conducted and the corrosion process was examined under the conditions combining the test conditions of the salt water spraying test method conforming to JIS Z 2371 (2000) and high-temperature high-humidity conditions.

The results obtained demonstrated that in samples No. A and B in which the surface area SAl of the test plate constituted by the aluminum alloy where the metal plated layers were formed was equal to the formation surface area of the metal plated layers, peeling of the metal plated layers was observed at the lamination surface (end surface) formed by lamination of the metal plated layers. In samples No. C and D in which the surface area of the metal plated layers was less than the surface area SAl of the test plate, the Zn layer eluted and the Sn layer located thereupon was removed from the test plate. In sample No. E in which the surface area of the metal plated layers was less than the surface area SAl of the test plate, and the surface area of the Sn layer was further reduced with respect to the surface area SAl, the Zn layer eluted and the Sn layer located thereupon was removed in the same manner as in samples No. C and D. Further, pitting corrosion 1010 was observed on the zones of the test plates of samples No. C, D, and E where the metal plated layers were not provided.

The above-described results confirmed that when the Zn layer was formed directly on the base material constituted by the aluminum alloy, the Zn layer eluted regardless of the size of the Zn layer formation region. As a result, the Sn layer provided above the Zn layer was removed and peeled off from the base material.

Test Example 2

A Sn layer was formed directly on an aluminum alloy plate, a corrosion test was performed, and the state of contact corrosion of dissimilar metals was examined.

In this test, an aluminum alloy plate (aluminum alloy plate corresponding to the 6061 alloy that was subjected to the T6 treatment) similar to that of Test Example 1 was prepared and cut to 20 mm×20 mm to obtain a test plate. A Sn layer (the Sn layer had a thickness of 0.1 μm, a round shape, and a diameter ϕ of 2 mm) was directly formed by an immersion plating method on the test plate. The sample obtained was used as sample No. 2-1. The immersion plating was performed by the process including the following steps: degreasing→etching→washing with water→pickling→washing with water→plating→washing with water. In the degreasing step, the steel plate was immersed in a commercial degreasing solution, then immersed in ethanol under stirring, and then ultrasonically washed. The etching step was performed by using an aqueous solution of sodium hydroxide (200 g/L, pH 12) as an alkali solution. The pickling step used a mixed acid-water solution in which nitric acid at 400 ml/L was mixed with 50% hydrofluoric acid at 40 ml/L. In the plating step, a Sn layer of the abovementioned thickness was formed by using a tin plating solution manufactured by Daiwakasei Industry Co., Ltd. (sodium stannate at 150 g/L+aqueous solution of sodium hydroxide (10 g/L, pH 12)). The steps of washing with water after etching and pickling were performed by ultrasonic washing, and washing with water after the plating step used flowing water. The thickness of the formed Sn layer was measured at the sample cross section by using a microscope (measurement region: 2 mm×20%=0.4 mm or more).

For comparison, sample No. D produced in Test Example 1 was prepared. The test plate has the same size (flat plate 20 mm×20 mm) as sample No. 2-1, the Sn layer had a thickness of 0.1 μm, the Zn layer and Sn layer had a round shape, and the diameter ϕ was 2 mm.

Figure 6:
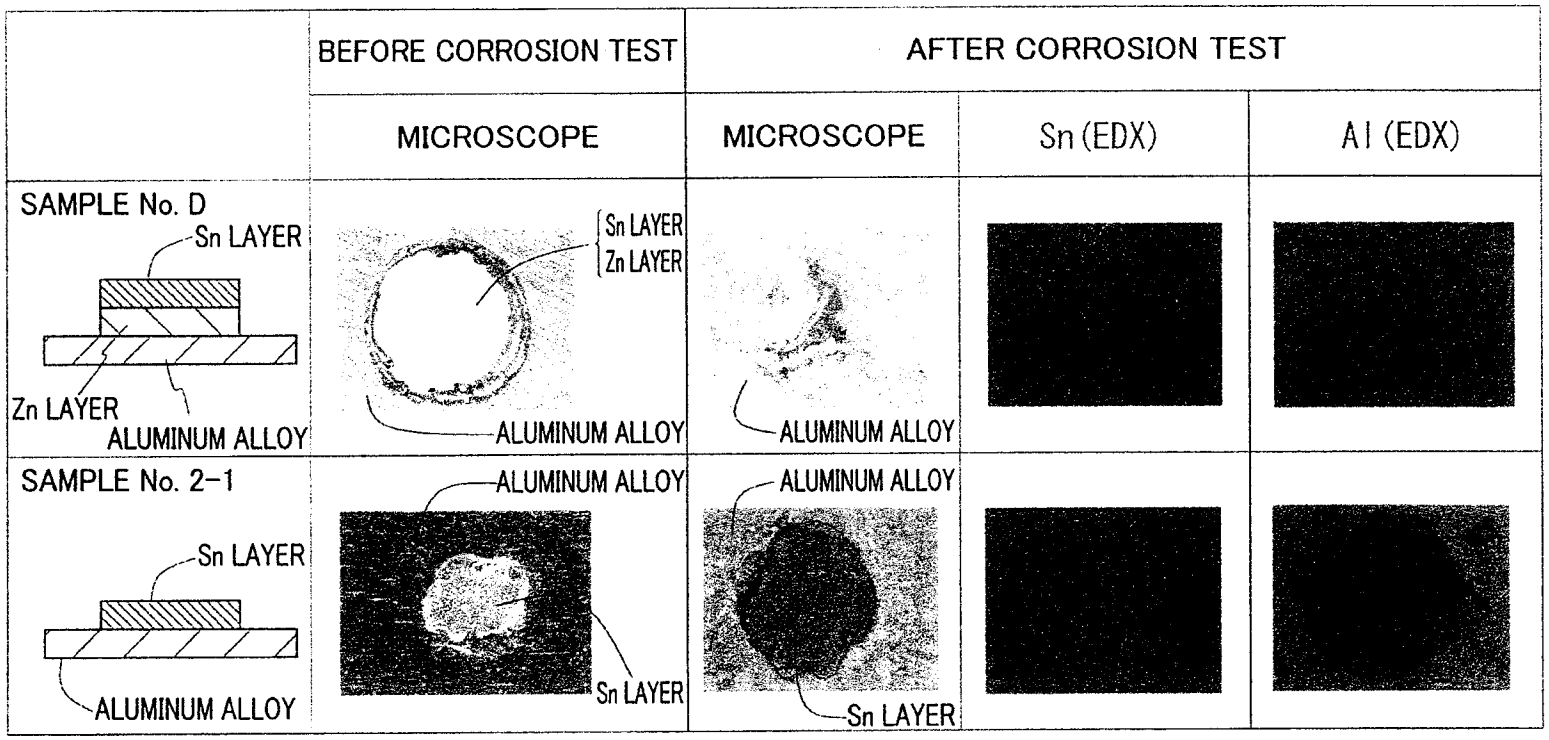
FIG. 6 is a microscopic image and element mapping of Samples No. 2-1 and D that were subjected to a corrosion test under the same conditions as those of Test Example 1.

Samples No. 2-1 and D were subjected to a corrosion test under the conditions same as those of Test Example 1 and the corrosion state was then checked. In this case, the external appearance was examined under an optical microscope and elemental analysis (Sn or Al) by EDX was performed with respect to the region where the metal plated layer was formed in the test plate and the vicinity thereof by using a scanning electron microscope (SEM) equipped with an energy-dispersive X-ray analyzer (EDX). The microscopic image and element mapping are shown in FIG. 6. In the element mapping, elements that are the object of analysis are shown by a light color and other elements are shown by a dark color.

The microscopic image of FIG. 6 demonstrates that sample No. D lost the Sn layer and Zn layer and the aluminum alloy base material could be observed after the corrosion test. Meanwhile, in sample No. 2-1, the Sn layer subjected to discoloration is present.

The elemental analysis results demonstrated that practically no Sn could be detected and an Al component of the aluminum alloy constituting the base material was detected in sample No. D. Meanwhile, in sample No. 2-1, the analysis of the Sn component revealed locations where the Sn component was detected and locations where the Sn component practically was not detected, and the analysis of the Al component revealed locations where the Al component was detected and locations where the Al component practically was not detected. The locations where the Sn component was detected and the regions where the Al component practically could not be detected were round regions, and it can be said that a sufficient fraction of the immersion-plated layer formed to have a round shape remained in sample No. 2-1.

The above-described results confirmed that by forming the Sn layer directly on the base material constituted by the aluminum alloy, it is possible to inhibit the loss and peeling of the Sn layer caused by contact corrosion of dissimilar metals.

Test Example 3

A Sn layer was directly formed on an aluminum alloy layer, and the relationship between the Sn layer thickness and adhesion was examined.

In this test, an aluminum alloy plate (aluminum alloy plate corresponding to the 6061 alloy that was subjected to the T6 treatment) similar to that of Test Example 1 was prepared and cut to an appropriate size to obtain a test plate. A Sn layer was directly formed by an immersion plating method on the test plate in the same manner as in Test Example 2. However, in this test, the formation conditions of the immersion plating method were adjusted to obtain samples with different Sn layer thickness. Thus, sample No. 3-1 had a Sn layer thickness of 0.1 μm, and sample No. 3-100 had a Sn layer thickness of 0.4 μm. In each sample, the immersion-plated layer was formed on the entire surface of the prepared test plate.

Figure 5:
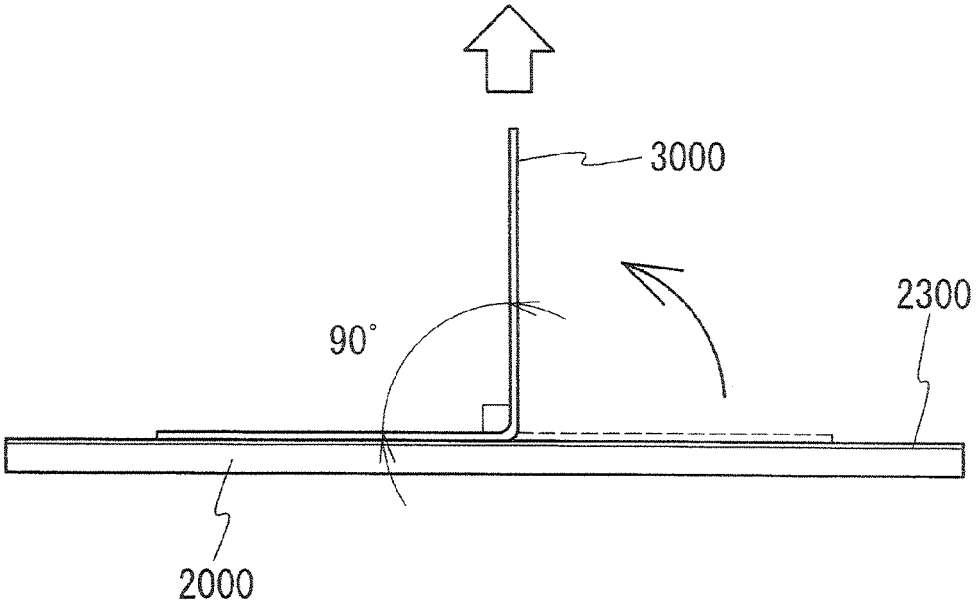
FIG. 5 is an explanatory drawing for explaining the adhesion test method.

The following adhesion test was performed with respect to the prepared samples No. 3-1 and 3-100. In the adhesion test, a commercial adhesive tape 3000 was attached (length 20 mm) to the surface of an immersion-plated layer 2300 formed on a test plate 2000, as shown in FIG. 5. One end of the adhesive tape 3000 was pulled upward, and the adhesive tape 3000 was peeled so that an angle between the region of the adhesive tape 3000 that was attached to the immersion-plated layer 2300 and the pulled-up region was 90°. The results are shown in FIG. 3A and FIG. 3B. A mending tape Scotch™ 810-1-12 manufactured by Sumitomo-3M was used as the adhesive tape 3000.

In sample No. 3-1 with a small Sn layer thickness, the Sn layer was not peeled off at all, as shown in FIG. 3A(a), after the adhesion test. Meanwhile, in sample No. 3-100 with a large Sn layer thickness, the Sn layer in the region where the adhesive tape was attached was entirely peeled off and the aluminum alloy of the base material was exposed, as shown in FIG. 3B(a), after the adhesion test.

The cross-sections of the produced samples No. 3-1 and 3-100 were examined under a SEM. As shown in FIG. 3A(b), in sample No. 3-1 in which a thin Sn layer was formed by immersion plating, substantially no void was present between the base material constituted by the aluminum alloy and the Sn layer and the Sn layer adhered to the base material. Meanwhile, in sample No. 3-100 in which the thick Sn layer was formed, a void was present along the entire Sn layer between the base material constituted by the aluminum alloy and the Sn layer, as shown in FIG. 3B(b). Such a void apparently occurs in sample No. 3-100 because the aluminum alloy constituting the base material is eluted as a result of contact corrosion of dissimilar metals occurring in the process of forming the Sn layer between the base material and the Sn layer that has already been formed. Since such a void is present, the Sn layer does not adhere to the base material, and the Sn layer can be easily peeled off from the base material by attaching and then tearing off the adhesive tape. By contrast, in sample No. 3-1, the Sn layer was unlikely to be peeled off from the base material due to the adhesion between the base material and the Sn layer.

Samples with aluminum alloys of different compositions were produced and the adhesion test was performed in the same manner. Sample No. 3-3 was from an aluminum alloy plate from a 2000 series alloy (corresponds to 2219 alloy) conforming to JIS that was subjected to the T6 treatment, and sample No. 3-4 was from an aluminum alloy plate from a 7000 series alloy (corresponds to 7075 alloy) conforming to JIS that was subjected to the T73 treatment. Sample No. 3-2 was from an aluminum alloy plate from a 6000 series alloy (corresponds to 6061 alloy) conforming to JIS that was subjected to the T6 treatment. A Sn layer with a thickness of 0.1 μm was directly formed on the base material (test plate) from the aluminum alloy by immersion plating in all of samples No. 3-2 to 3-4.

The adhesion test using a commercial adhesive tape was performed as described hereinabove. The results are shown in FIG. 4. FIG. 4A shows sample No. 3-2 (corresponds to the 6061 alloy), FIG. 4B shows sample No. 3-3 (corresponds to the 2219 alloy), and FIG. 4C shows sample No. 3-4 (corresponds to the 7075 alloy). As shown in FIG. 4, the Sn layer did not peel off and the Sn layer adhered to the base material constituted by the aluminum alloy after the adhesion test in all of samples No. 3-2 to 3-4.

The above-described results confirm that where a Sn layer is formed by immersion plating on the base material from an aluminum alloy, excellent adhesion between the base material and the Sn layer is achieved by forming a comparatively thin layer. Such results lead to a conclusion that in order to form a Sn layer of a certain large thickness, it is preferred, for example, that a thin layer (preferably with a thickness equal to or less than 0.3 μm) be formed by immersion plating and then a layer of the desired thickness be formed thereupon by electroplating or vacuum plating.

Test Example 4

A Sn layer was directly formed on an aluminum alloy plate and the relationship between the size of the Sn layer formation region and the corrosion state induced by contact corrosion of dissimilar metals was examined.

In this test, an aluminum alloy plate (aluminum alloy plate corresponding to the 6061 alloy that was subjected to the T6 treatment) similar to that of Test Example 1 was prepared and cut to 20 mm×20 mm to obtain a test plate. A Sn layer was directly formed on the test plate. In this test, an immersion-plated layer with a thickness of 0.1 μm was formed by immersion plating in the same manner as in sample No. 3-1 of Test Example 3 and an electroplated layer with a thickness of 0.9 μm was formed by electroplating thereupon, thereby forming a Sn layer with a total thickness of 1 μm. A tin plating solution (aqueous solution of tin salt for plating 46 g/L+acid for plating 48 g/L+additive 85 ml/L) manufactured by Ishihara Yakuhin Co., Ltd. was used for electroplating, and washing with water flow was performed after the plating. Samples No. 4-1 to 4-4 all had the same total thickness (1 μm) of the Sn layer and only the surface area of the formation region was different. More specifically, sample No. 4-1 had a round shape with a diameter of 1.0 mm, sample No. 4-2 had a round shape with a diameter of 2.0 mm, sample No. 4-3 had a round shape with a diameter of 3.0 mm, and sample No. 4-4 had a round shape with a diameter of 5.0 mm. The ratio of the surface area of the Sn layer to the exposed surface area of the test plate constituted by the aluminum alloy was about 0.1% in sample No. 4-1, about 0.4% in sample No. 4-2, about 0.9% in sample No. 4-3, and about 2.5% in sample No. 4-4. The exposed surface area of the test plate is calculated by subtracting the surface area of the round Sn layer from a total surface area of 800 mm2 of the surface where the Sn layer is provided and the opposing surface, the side surface of the test plate (surface along the thickness direction of the test plate) being ignored.

The corrosion test was conducted with respect to the produced samples No. 4-1 to 4-4 under the same conditions as in Test Example 1 and the corrosion state was thereafter checked. The external appearance in this case was studied under an optical microscope. The results are shown in FIG. 7.

As shown in FIG. 7, where the size of the Sn layer formation region is reduced (where the aforementioned surface area ratio is made equal to or less than 0.6% (in this case, less than 0.5%)), the Sn layer does not peel off and sufficient amount thereof can remain.

The above-described results confirmed that where the size of the Sn layer is made comparatively small in relation to the exposed surface area of the base material when the Sn layer is formed on part of the surface of the base material constituted by the aluminum alloy, the Sn layer is unlikely to be peeled off due to contact corrosion of dissimilar metals. Therefore, those results can be said to indicate that when the Sn layer is formed on part of the base material surface, for example, when the Sn layer is used as a contact material, the presence of the Sn layer can be ensured over a long period of time by adjusting the Sn layer formation region.

With respect to Test Examples 2 to 4, a Sn layer was formed by plasma sputtering on the base material constituted by the aluminum alloy and the corrosion state determined by contact of dissimilar metals and the adhesion were similarly examined. The results confirmed that the base material and the Sn layer demonstrated excellent adhesion to each other, the Sn layer had high peel resistance, and the loss or peeling of the Sn layer caused by contact corrosion of dissimilar metals could be inhibited.

The test results demonstrate that by directly forming a Sn layer on at least part of the surface of the terminal fitting constituted by an aluminum alloy, it is possible to prevent the Sn layer from peeling and ensure the presence of the Sn layer over a long period of time. In particular, where the Sn layer is formed on the contact region in the electric connecting portion that is electrically connected to a separate connection object, more specifically, to the contact region of the male fitting portion provided at the male terminal fitting or the contact region of the female fitting portion provided at the female terminal fitting, the Sn layer can be effectively used as a contact material, and a connecting structure (for example, terminal connecting structure of electric wires) with a low connection resistance can be expected to be obtained.

The present invention is not limited to the above-described embodiments and can be variously changed without departing from the essence of the present invention. For example, the composition of the terminal fitting and the thickness of the Sn layer can be changed, as appropriate.

INDUSTRIAL APPLICABILITY

The terminal fitting in accordance with the present invention and the terminal connecting structure of an electric wire in accordance with the present invention can be advantageously used for constituent members of wiring structures of mobile equipment such as electric automobiles and airplanes, or industrial equipment such as robots. In particular, since the main component is aluminum and, therefore, has a small weight, the present invention can be advantageously used for constituent members of wire harnesses for electric automobiles.

The invention claimed is:

1. An aluminum-based terminal fitting comprising:

a conductor connecting portion for connection to a conductor of an electric wire, and an electric connecting portion that is provided to extend from the conductor connecting portion and is electrically connected to a separate connection object, the aluminum-based terminal fitting having a composition that consists of a base material that is of aluminum or an aluminum alloy, and a Sn layer directly formed on the base material, the Sn layer provided on at least a contact region of the electric connecting portion;

the Sn layer comprising an immersion-plated layer having a thickness of 0.05 μm to 0.3 μm carried directly by the base material, and an electroplated layer having a thickness of 0.25 μm to 1.7 μm carried directly by the immersion-plated layer.

2. The aluminum-based terminal fitting according to claim 1, wherein the electric connecting portion is a fitting portion adapted to fit with a second electric connecting portion of a second terminal fitting, and wherein the electric connecting portion includes a contact region, wherein the Sn layer is provided on the contact region.

3. The aluminum-based terminal fitting according to claim 1, wherein a ratio of a surface area of the Sn layer to an exposed surface area of the base material is 0.02% to 0.6%.

4. The aluminum-based terminal fitting according to claim 1, wherein the base material is an aluminum alloy selected from the group consisting of a 2000 series alloy, a 6000 series alloy, a 7000 series alloy.

5. The aluminum-based terminal fitting according to claim 1, wherein the Sn layer passes a 90 degree peel test.

6. The aluminum-based terminal fitting according to claim 1, having substantially no voids present at a boundary of the aluminum base material and the Sn layer.

7. A terminal connecting structure of an electric wire, comprising an electric wire provided with a conductor, and a terminal fitting attached to an end portion of the conductor, wherein the conductor is aluminum or an aluminum alloy, and wherein the terminal fitting is an aluminum-based terminal fitting having a composition that consists of a base material that is aluminum or an aluminum alloy, and a Sn layer directly formed on the base material; the Sn layer comprising an immersion-plated layer having a thickness of 0.05 μm to 0.3 μm carried directly by the base material, and an electroplated layer having a thickness of 0.25 μm to 1.7 μm carried directly by the immersion-plated layer.

8. An aluminum-based terminal fitting consisting of an aluminum base material, an immersion-plated tin layer having a thickness of 0.05 μm to 0.3 μm carried directly on the base material, and an electroplated tin layer having a thickness of 0.25 μm to 1.7 μm carried directly by the immersion-plated layer.

9. The aluminum-based terminal fitting of claim 8, wherein the aluminum base material is aluminum or an aluminum alloy selected from the group consisting of a 2000 series alloy, a 6000 series alloy, and a 7000 series alloy.

10. The aluminum-based terminal fitting of claim 8, wherein the aluminum base material has a surface area; and wherein the immersion-plated tin layer is carried on less than 0.6% of the aluminum base material surface area.

11. The aluminum-based terminal fitting of claim 8, wherein the electroplated tin layer passes a 90 degree peel test.

12. The aluminum-based terminal fitting of claim 8, having substantially no voids present at a boundary of the aluminum base material and the immersion-plated tin layer.

* * * * *